United States Patent [19]

Haney et al.

[11] Patent Number: 5,051,037

[45] Date of Patent: Sep. 24, 1991

[54] TOWER WITH FOLDING BRACES FOR FIXED OFFSHORE PLATFORM

[75] Inventors: James A. Haney, Bellaire, Tex.; Stafford J. Menard, Houma, La.

[73] Assignee: McDermott International, Inc., New Orleans, La.

[21] Appl. No.: 579,510

[22] Filed: Sep. 10, 1990

[51] Int. Cl.[5] ..... E02B 17/02

[52] U.S. Cl. ..... 405/227; 405/203; 405/209

[58] Field of Search ..... 405/195, 203, 204, 205, 405/207, 209, 224, 225, 227; 248/168, 169, 170, 434

[56] References Cited

U.S. PATENT DOCUMENTS

| | | | |
|---|---|---|---|
| 2,709,560 | 5/1955 | Resk | 248/169 |
| 2,903,856 | 9/1959 | Endean | 405/225 |
| 4,000,624 | 1/1977 | Chow | 405/204 |
| 4,669,917 | 6/1987 | Sveen | 405/227 |
| 4,695,202 | 9/1987 | Aggradi et al. | 405/227 |
| 4,812,080 | 3/1989 | Urquhart et al. | 405/227 |
| 4,813,638 | 3/1989 | Garcia | 248/169 X |

FOREIGN PATENT DOCUMENTS

| | | | |
|---|---|---|---|
| 2924374 | 12/1980 | Fed. Rep. of Germany | 405/204 |

*Primary Examiner*—Dennis L. Taylor
*Assistant Examiner*—John A. Ricci
*Attorney, Agent, or Firm*—R. J. Edwards; Michael L. Hoelter

[57] ABSTRACT

This invention pertains to a braced offshore structure that is constructed on land as a single unit in a compact bundle before being transported on a barge to the installation site. After the compact unit is launched, it is unfolded and ballasted before being installed upon the ocean floor. This structure consists of an elongated central tower having a plurality of braces pivotally secured thereto. These braces are initially positioned generally parallel to this central tower within recesses in the central tower but after the braces are unfolded, they extend at an angle to the central tower.

15 Claims, 7 Drawing Sheets

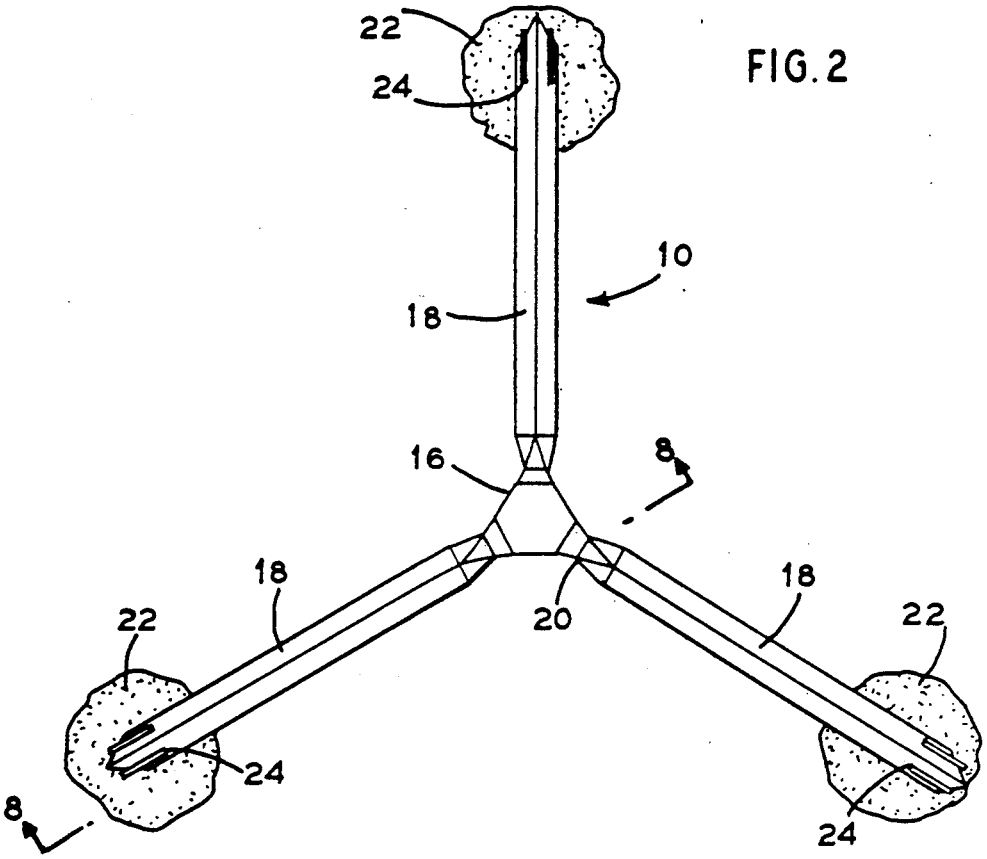
FIG. 2
FIG. 3
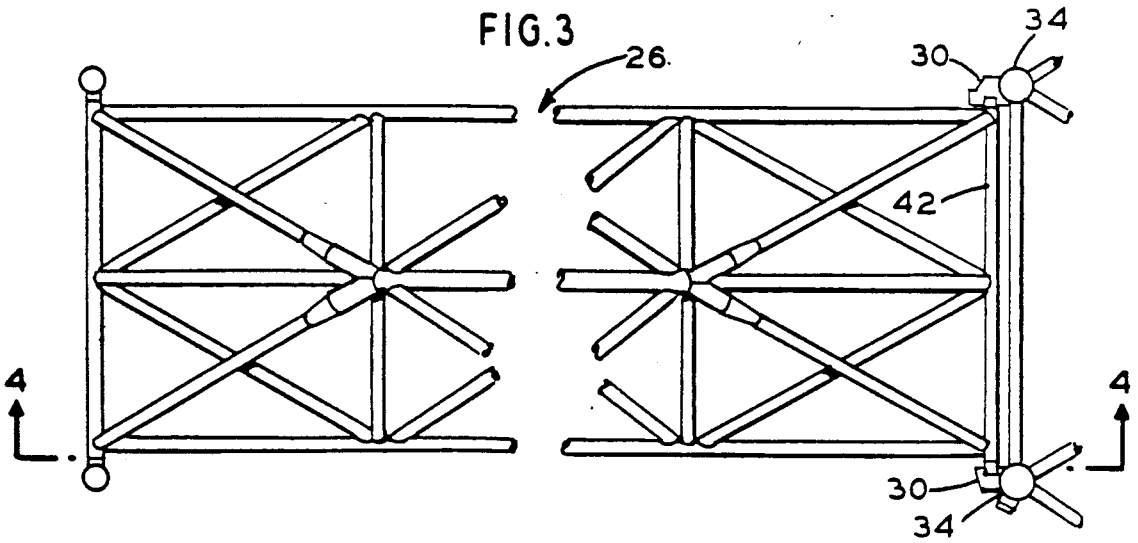
FIG. 4
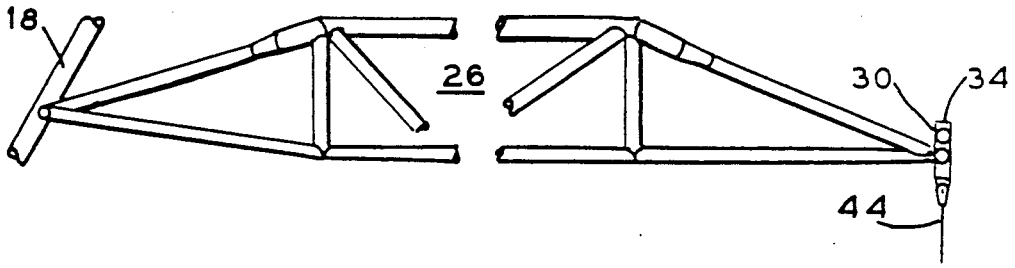

FIG. 5
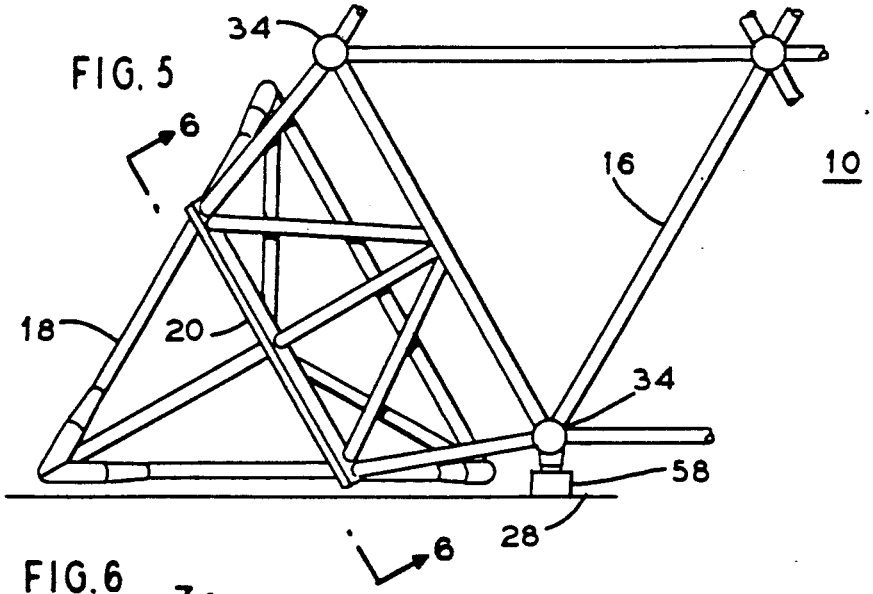
FIG. 6
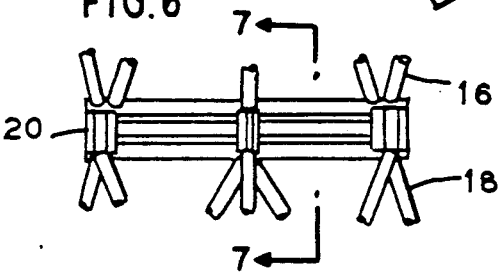
FIG. 7
FIG. 9
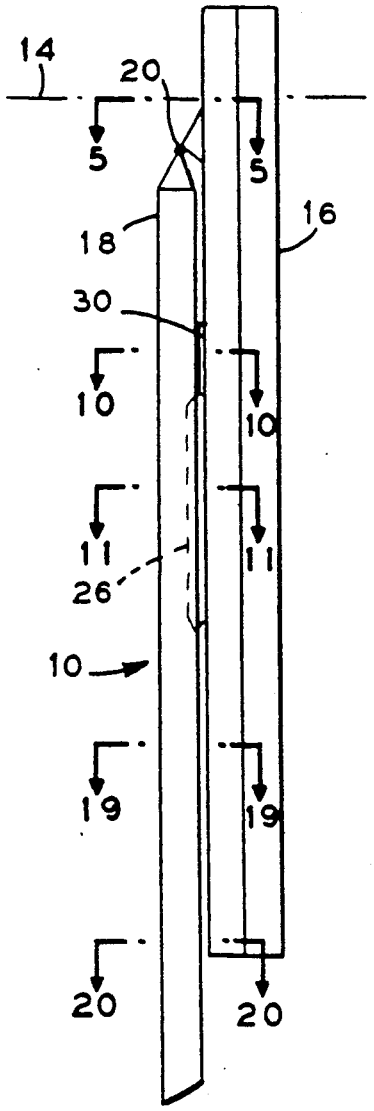
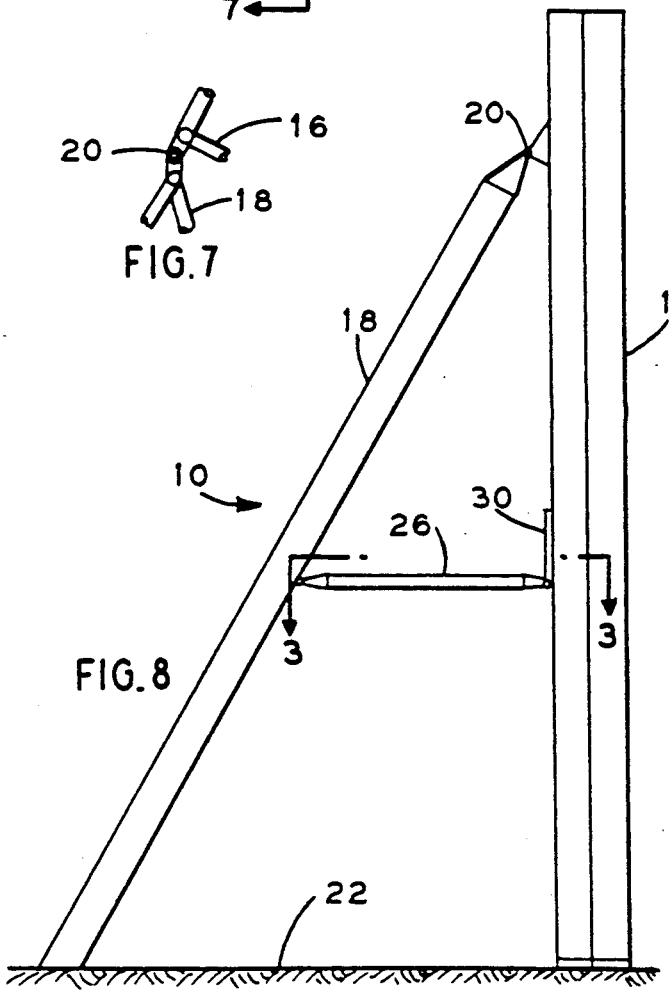
FIG. 8

FIG. 13
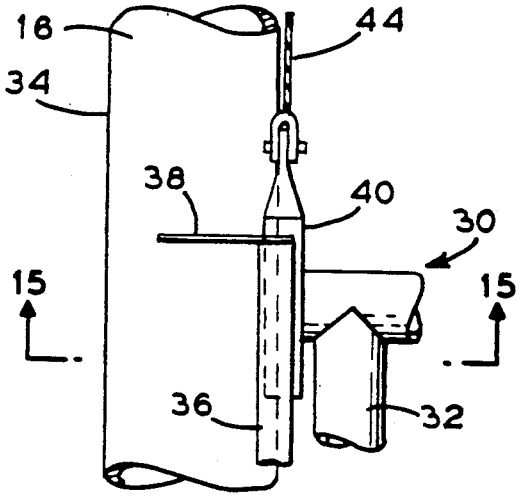
FIG. 15
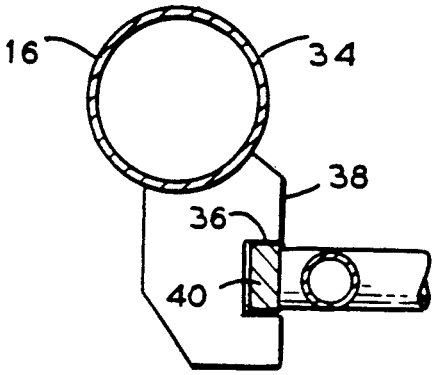
FIG. 16
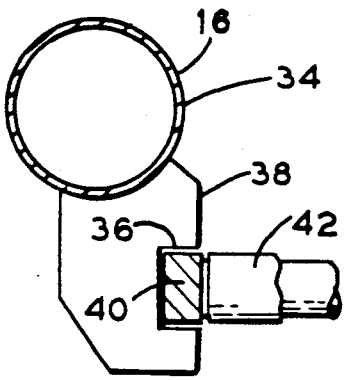
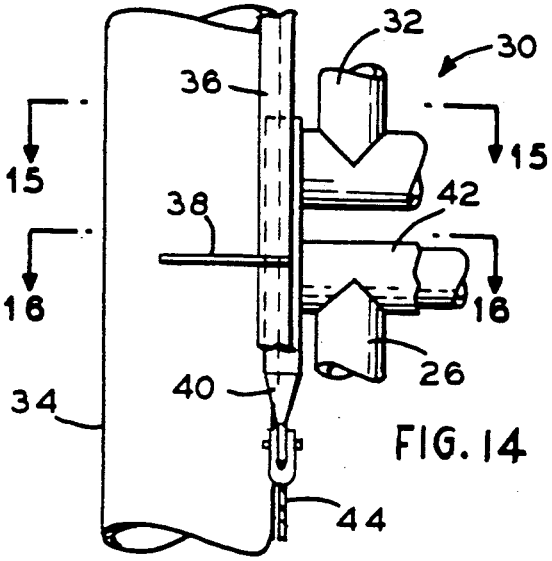
FIG. 14
FIG. 17
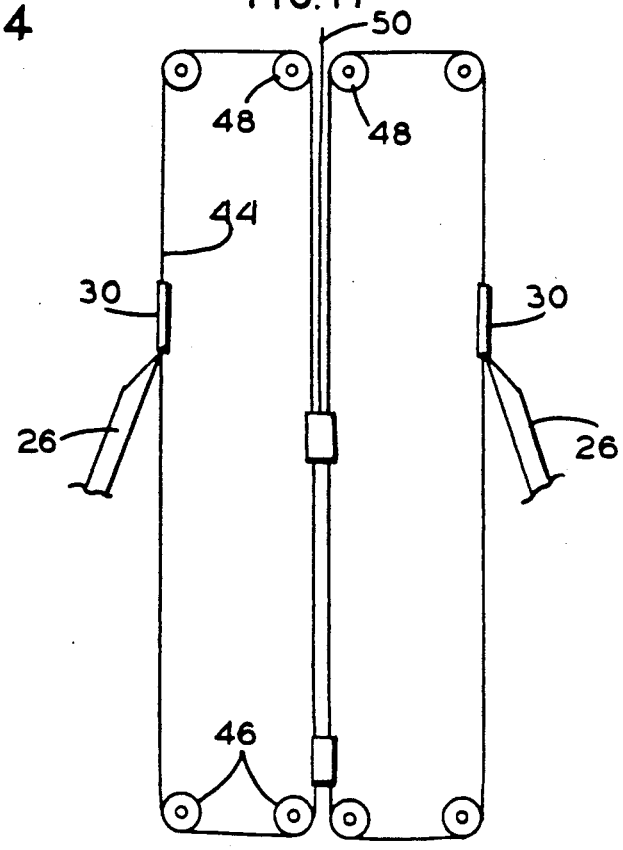
FIG. 18
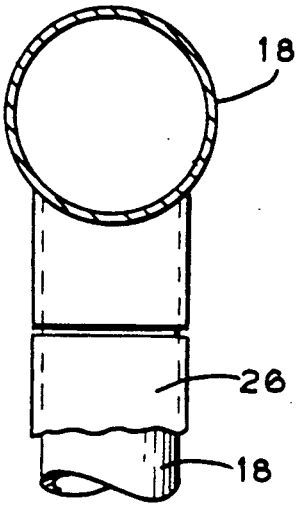

TOWER WITH FOLDING BRACES FOR FIXED OFFSHORE PLATFORM

FIELD OF THE INVENTION

This invention pertains to braced offshore structures and more particularly to a means of fabricating the structure onshore in a compact bundle, transporting the bundle, and unfolding the bundle to the final configuration near the offshore site.

BACKGROUND OF THE INVENTION

As is well known, fabricating structures on land is less expensive and risky than doing the same work offshore. However, during the construction of offshore structures, a certain amount of offshore assembly time is generally required. To minimize these costs, these structures are often subdivided into a few large components.

One such component of an offshore structure is the substructure, which generally extends from the sea floor to an elevation above the water surface. The substructure is normally fabricated on its side onshore, skidded onto a barge, towed to the site, launched from the barge, upended to a vertical orientation while floating, and set on the bottom by ballasting. Piling is then driven into the sea floor through features in the substructure afterwhich the substructure is secured to the driven piling by grouting, welding, or other mechanical means.

In most cases, the substructure is a cantilever tower, but there are certain circumstances, however, when a braced tower is a more efficient (lighter) structure. In order to realize savings from the lighter weight of the braced tower, a low risk, economical method of fabrication and installation must be devised.

Methods already have been developed which involve assembling braced towers at the offshore site. Under these methods, the central tower and the braces, which are each independently fabricated onshore, are separately transported to the offshore site. After launching, each brace is connected to the tower thereby completing the substructure. Assembling the substructure in this fashion is both expensive and risky because of the length of time required and because a storm can strike at any time.

It is thus an object of this invention to devise a braced tower that can be fabricated entirely onshore in a compact bundle, transported to the offshore installation site, placed in the water, and opened to its final configuration while floating. Another object of this invention is to devise a braced substructure that can be deployed and installed with an absolute minimum of offshore assembly and/or construction time required. A further object of this invention is to provide a compact substructure that can be towed to the site and launched without requiring elaborate reconfiguration of the transport vessel. A further object of this invention is to provide sufficient clearances such that piling can be driven to anchor this unfolded structure in place. These and other advantages will become apparent upon further investigation.

SUMMARY OF THE INVENTION

This invention pertains to a substructure of a fixed offshore platform that takes the form of a braced central tower that is fully constructed on land. The braces are pivotally connected to the tower and fold alongside the tower thereby forming a compact bundle. The cross section of the tower is configured with recesses into which the braces are folded. Additionally, no elements of the bundle protrude into space during fabrication and transportation of the bundle which would hinder such fabrication and transportation. After the bundle is placed in the water at the site, it is unfolded to its final configuration while floating and then set on the ocean floor by ballasting.

BRIEF DESCRIPTION OF THE DRAWINGS

FIG. 2 is a plan view, without the superstructure, of the invention installed on the ocean floor.

FIG. 3 is a plan view of the strut as disclosed herein and taken along lines 3—3 of FIG. 8.

FIG. 4 is a sectional view of the strut taken along lines 4-4 of FIG. 3.

FIG. 5 is a plan view of a hinged connection taken along lines 5-5 of FIG. 9.

FIG. 6 is a sectional view, partially cut away, taken along lines 6-6 of FIG. 5.

FIG. 7 is a sectional view, partially cut away, taken along lines 7-7 of FIG. 6.

FIG. 8 is a partial elevation view (only one brace is shown) taken along lines 8—8 of FIG. 2 and showing the invention in its unfolded position.

FIG. 9 is a partial elevation view (only one brace is shown) illustrating the invention in its folded position.

FIG. 13 is an enlarged detail view, partially cut away, of a portion of FIG. 12.

FIG. 14 is an enlarged detail view, partially cut away, of a portion of FIG. 12.

FIG. 15 is a sectional view, partially cut away, taken along lines 15—15 of FIGS. 13 and 14.

FIG. 16 is a sectional view, partially cut away, taken along lines 16—16 of FIG. 14.

FIG. 17 is a schematic view of the operation of the slide assembly.

FIG. 18 is an enlarged detail view, partially cut away, of a portion of FIG. 3.

DETAILED DESCRIPTION OF THE INVENTION

Figure 1:
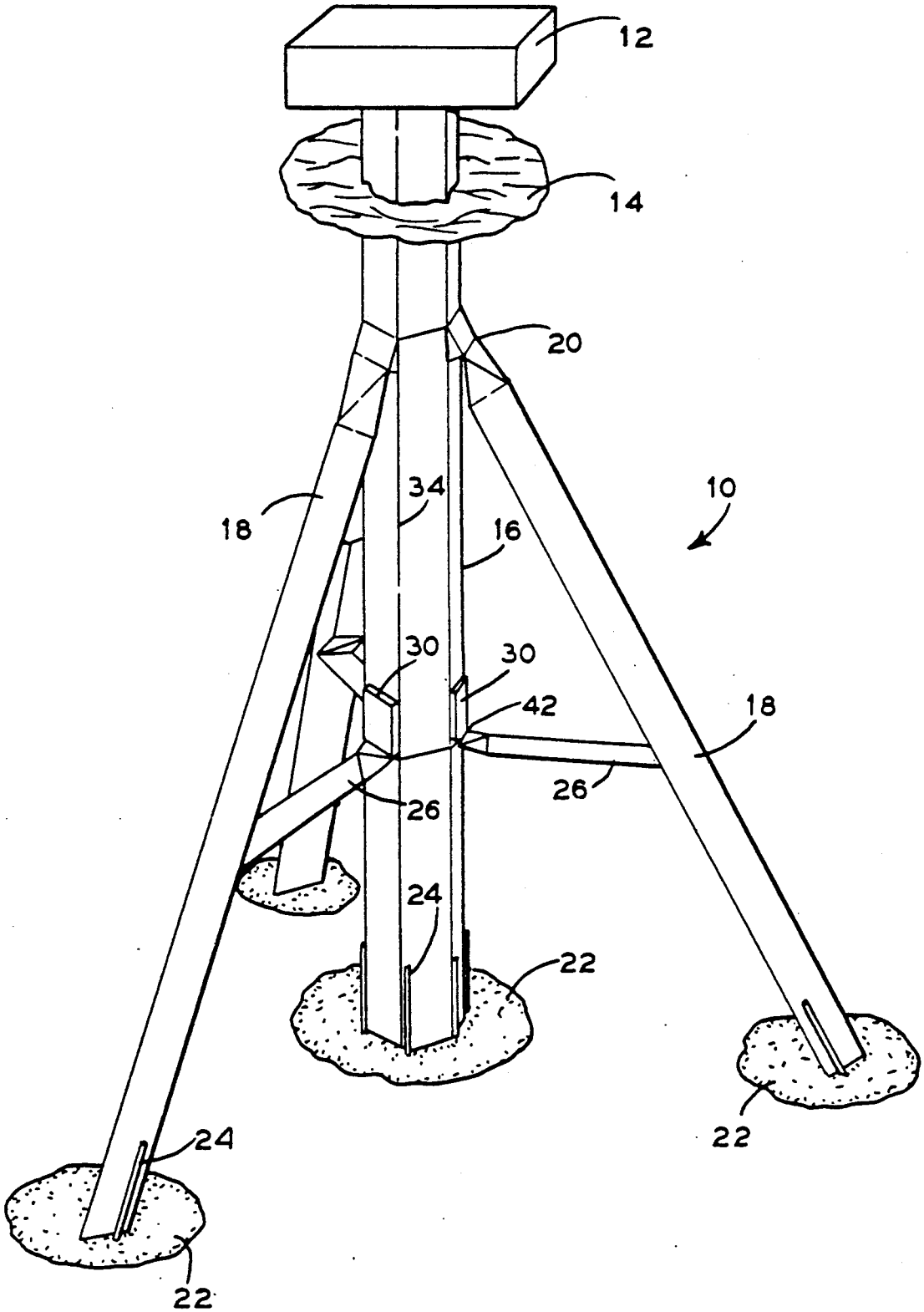
FIG. 1 is a pictorial view of the invention secured to the ocean floor.

As can be seen from the drawings, substructure 10 is a braced structure that is constructed as a compact bundle for towing purposes but which is unfolded while floating in the water before being installed on the ocean bottom. The ability of being able to completely assemble such a braced structure on land should not be overlooked in view of the fact that earlier braced structures required a certain amount of offshore construction.

An additional feature is the ability of this compact bundle to be loaded onto a transport barge such that it rests upon parallel rows of transport barge ways. Since the ways are in parallel rows, they can guide and/or support the structure as it slides by during the launching operation (presuming, of course, the structure is not lifted into place). Instead, if the ways are not in parallel rows, they will interfere with the launching operation because they are unable to support the structure as it moves by (i.e. they would no longer be aligned with the support points on the structure).

A further feature is the capacity of the individual braces to nestle alongside or be folded into recesses in the central tower (this capability being a factor of the geometry of the central tower). These recesses provide room and sufficient clearance so that the braces do not extend outward from the compact bundle to such a degree that they interfere with the loading of substructure 10 upon the transport barge.

Referring now initially to FIGS. 1 and 2, there is shown substructure 10 supporting superstructure 12 above waterline 14. Substructure 10, in this embodiment, comprises central tower 16 and three outwardly extending braces 18. Braces 18 support tower 16 by restraining tower 16 in place against the effects of any external forces incurred by either substructure 10 or superstructure 12. Both tower 16 and braces 18 can be open trusses as illustrated herein.

Each brace 18 has one end secured to tower 16 by means of a hinged connection 20 while the other end of each brace 18 is angled away from tower 16 when in the unfolded position. This end engages mudline 22 where skirt piles 24 anchor each brace 18 in place. As shown, tower 16 is also anchored in place by skirt piles 24.

As shown in this embodiment (but which is not necessary in every embodiment), strut 26 is disclosed to aid in the support of superstructure 12 and to increase the strength of both tower 16 and braces 18. Strut 26 (which is shown as an open truss in FIGS. 3 and 4) extends generally horizontally between each of braces 18 and central tower 16. It connects at an elevation intermediate hinged connection 20 and mudline 22 of each of tower 16 and braces 18. Strut 26 effectively decreases the unbraced length of both tower 16 and braces 18 such that their design may be minimized (a longer unbraced length requires more material thereby making the structure heavier and bulkier).

FIGS. 5, 6, and 7 show in greater detail the specifics of hinged connection 20 between each of braces 18 and tower 16. Other configurations are also possible, depending upon the forces involved, the sizes of the braces and the configuration of tower 16.

In this embodiment, tower 16 is configured having a hexagonal cross-section, but other cross-sectional shapes are equally likely. In theory, any cross-sectional shape that can accommodate a series of perimeter braces 18 is workable. One important factor is the ability of each such brace 18 to be constructed in its folded position alongside central tower 16 with sufficient clearance between adjacent braces for substructure 10 to be supported upon transport barge 28. It should here be noted that FIG. 5 illustrates hinged connection 20 in its folded position which is how it will appear during fabrication onshore and upon transport barge 28 during the towing operation.

Referring now to FIGS. 8 and 9, one possible embodiment of the installation procedure of substructure 10 is disclosed. FIG. 8 illustrates substructure 10 in its unfolded or installed position while FIG. 9. shows tower 16, one brace 18 (the others would operate identically) and strut 26 in their folded or towing and launching position. As can be surmised, after launching and while substructure 10 is floating, each of braces 18 is unbundled and pivoted away from tower 16 via their respective hinged connection 20. To accomplish this, each strut 26 is moved from its folded position parallel to tower 16 to its unfolded position generally perpendicular to tower 16. This repositioning of strut 26 is made possible by means of slide assembly 30 secured along tower 16 and by means of a hinged connection to its respective brace 18. The details of slide assembly 30 are shown in FIGS. 10 through 17 while the hinged connection between brace 18 and strut 26 is disclosed in FIG. 18.

Shown more specifically in FIG. 8, the bottom of tower 16, while anchored to mudline 22 via skirt piles 24, does not generally come into contact with mudline 22. Instead, tower 16 is supported just slightly above mudline 22 thereby creating a gap between the two. This is to allow braces 18 to fully engage the ocean bottom without any hindrance from central tower 16.

As shown in this embodiment, slide assembly 30 consists of an open truss 32 spanning between adjacent legs 34 of tower 16. Truss 32 is generally a rectangular planar structure that slides within two parallel slide rails 36 which are attached to legs 34. Each slide rail 36 extends partially along each of legs 34 with a series of plates 38 securing each slide rail 36 to its respective leg 34. Four slide blocks 40, one secured to each corner of truss 32, are configured to slide within slide rails 36 thus, as slide blocks 40 move within rails 36, so does truss 32.

Immediately below truss 32 and also secured to lower blocks 40 is hinge 42 which connects between these lower blocks 40 and one end of strut 26 (FIGS. 3 and 14). In this fashion, as each truss 32 moves downward along rails 36, strut 26 is pivoted from a position generally parallel to tower 16 to a position generally perpendicular to tower 16 via hinge 42 and the hinged connection between it and its respective brace 18. Such movement of strut 26 consequently pivots this brace 18 away from tower 16 about connection 20 as can be expected to occur. In addition to moving strut 26 downward, slide assembly 30, being confined between slide rails 36, prevents strut 26 from twisting during this unfolding operation.

The operation of slide assembly 30 is shown diagrammatically in FIG. 17. While only one such method of operation is shown herein, other similar methods may be contrived to achieve the same result, such as by the use of hydraulic cylinders. In fact, in some cases, there will be no need for either struts 26 or slide assemblies 30 for operation. In these instances, the unfolding operation will occur simply by rotating substructure 10 while it is floating upright in the water and by selectively de-ballasting braces 18 one at a time thereby causing each such brace 18 to pivot upward towards waterline 14. After the desired angle is achieved, the brace can simply be locked in place before substructure 10 is flooded and installed on the ocean floor.

However, in the embodiment illustrated in these drawings, one end of a cable 44 is secured to an upper block 40 while the other end of cable 44 is secured to its respective lower block 40. Intermediate these connections, cable 44 is routed through a series of turning sheaves 46 and a capstan 48. Since there are three braces 18 with each brace having its own slide assembly 30 and with each slide assembly 30 requiring two cables each, there is needed a total of six cables 44 for operation. These six cables 44 are ultimately coupled to a single lifting cable 50 that extends above waterline 14. Thus, as lifting cable 50 is pulled upward by means such as a winch, this upward movement causes all of cables 44 to move the three slide assemblies 30 downward simultaneously. This in turn uniformly pivots each strut 26 outward thereby forcing its respective brace 18 to also pivot outward about hinged connection 20 thereby unfolding all of braces 18 in unison. Additionally, once each strut 26 is completely unfolded and in a position generally perpendicular to tower 16, it acts as a lock to prevent each brace 18 from re-folding or pivoting back against tower 16. Upon completion of the unfolding operation, substructure 10 is ballasted to settle on the ocean bottom, and then anchored in place via skirt piles 24.

Figure 10:
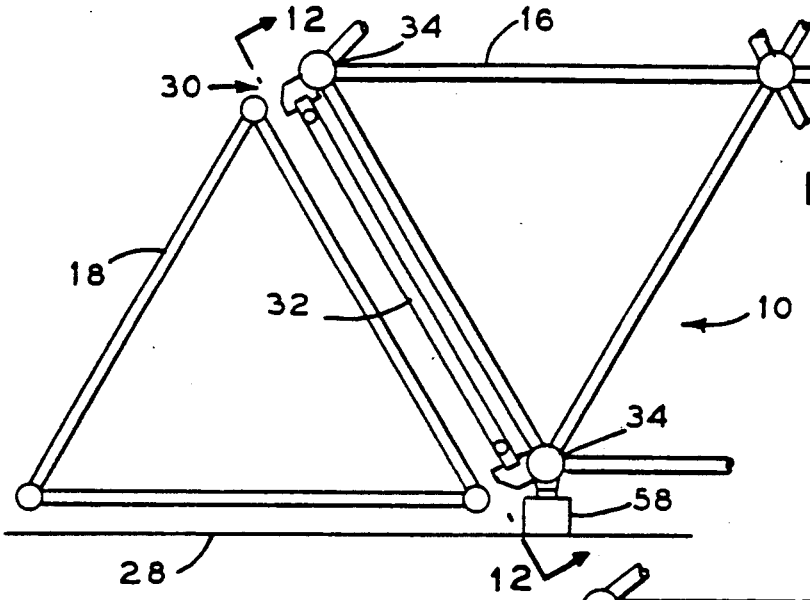
FIG. 10 is a sectional view of the invention on the transport barge and in its folded position taken along lines 10-10 of FIG. 9.
Figure 11:
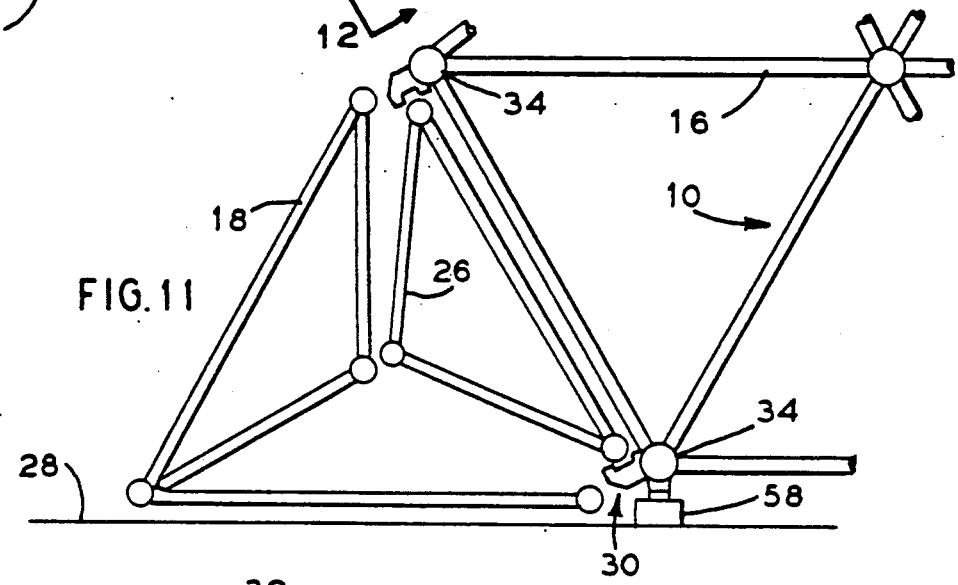
FIG. 11 is a sectional view of the invention on the transport barge and in its folded position taken along lines 11—11 of FIG. 9.
Figure 12:
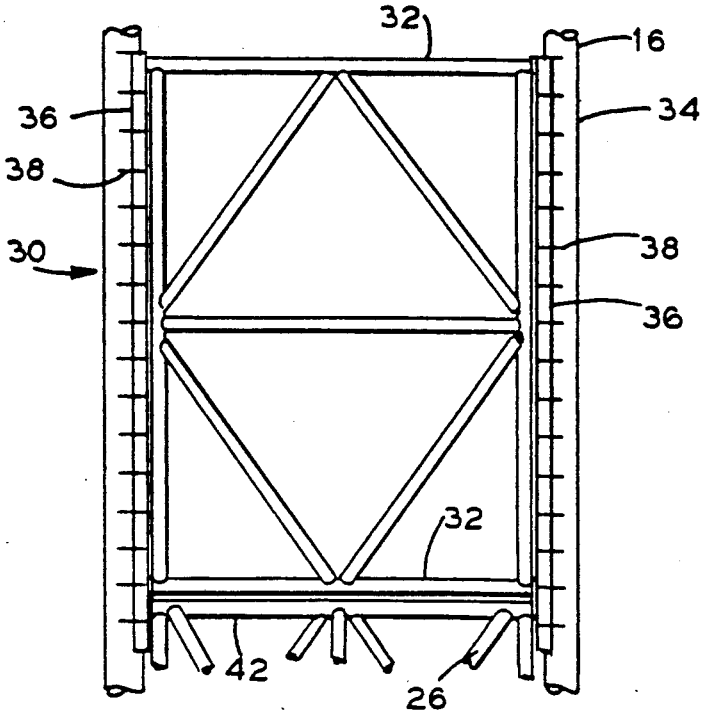
FIG. 12 is an elevation view, partially cut away, taken along lines 12—12 of FIG. 10.

It should here be noted that the cross-section of brace 18 does not remain constant throughout it length. Instead as indicated in FIGS. 10 and 11, provisions are made to accommodate the configuration of strut 26 so that substructure 10 can be folded into a compact shape for transportation. FIGS. 10 and 11 illustrate strut 26 nestled against brace 18 as substructure 10 is in its folded position upon transport barge 28.

Figure 19:
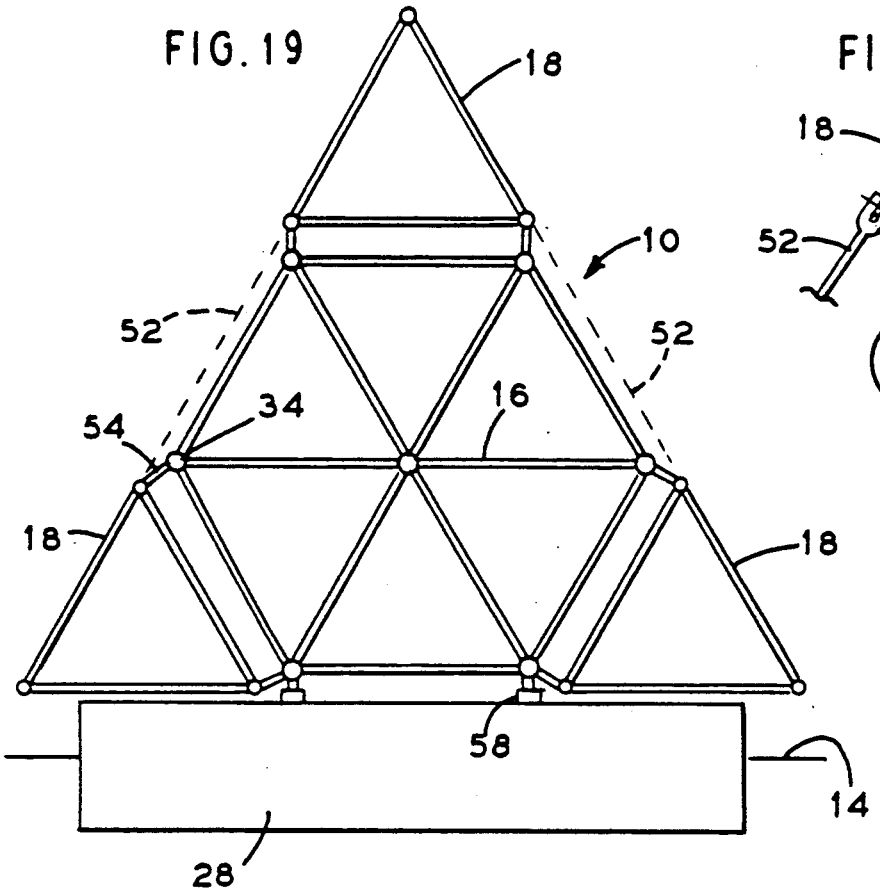
FIG. 19 is a sectional view of the invention on the transport barge and in its folded position taken along lines 19—19 of FIG. 9.
Figure 21:
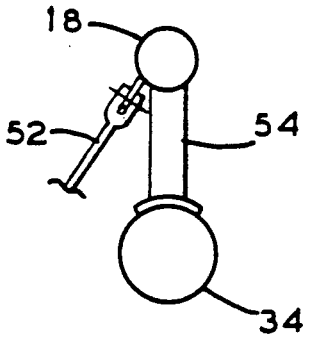
FIG. 21 is an enlarged detail view, partially cut away, of a portion of FIG. 19.
Figure 22:
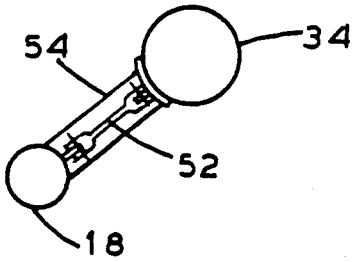
FIG. 22 is an enlarged detail view, partially cut away, of a portion of FIG. 19.
Figure 20:
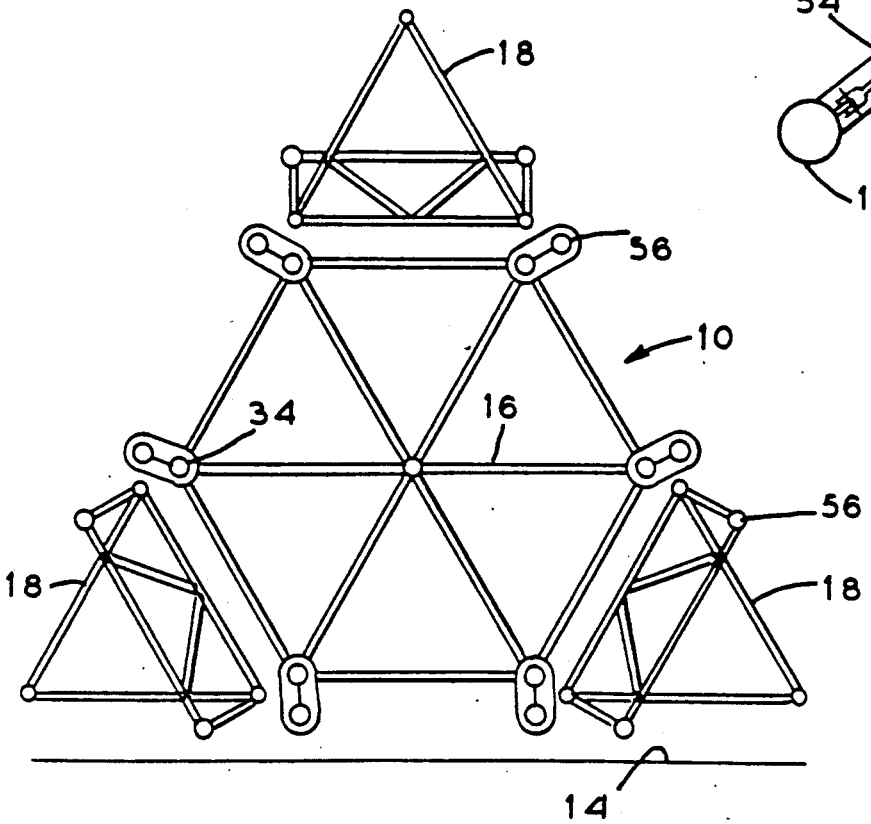
FIG. 20 is a sectional view of the invention on the transport barge and in its folded position taken along lines 20—20 of FIG. 9.

Referring now to FIGS. 19 through 22, there is shown additional sectional views through folded substructure 10. In FIG. 19, the position and orientation of substructure 10 upon transport barge 28 is illustrated. Also shown are details of how braces 18 are confined in the folded position by cables 52 and spacer stubs 54. After substructure 10 is placed in the water, cables 52 are cut thereby enabling braces 18 to pivot outward. As can be seen, this compact arrangement provides sufficient clearance between any part of substructure 10 and transport barge 28. FIG. 20 discloses the various skirt pile sleeves 56 attached to both central tower 16 and braces 18 through which skirt piles 24 are driven into the ocean bottom. As also indicated, this portion of substructure 10 extends beyond the stern of transport barge 28 thereby being cantilevered out over the water so as to accommodate these extending skirt pile sleeves 56.

Figure 23:
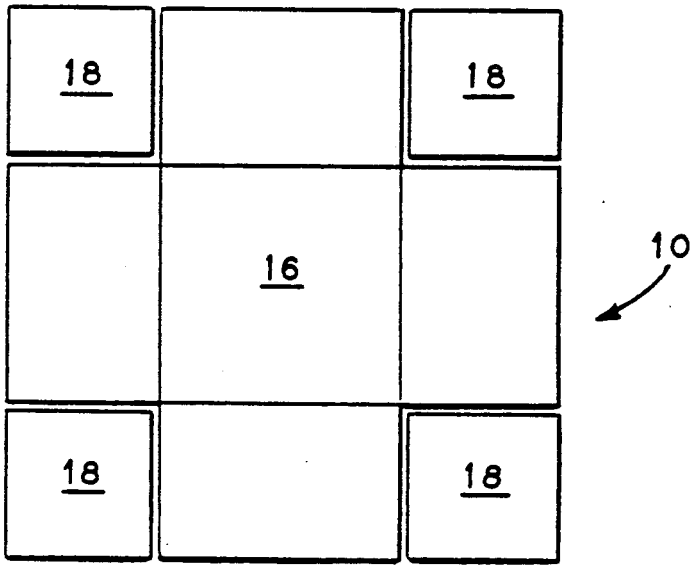
FIG. 23 discloses an alternate cross-section of a bundled substructure.
Figure 24:
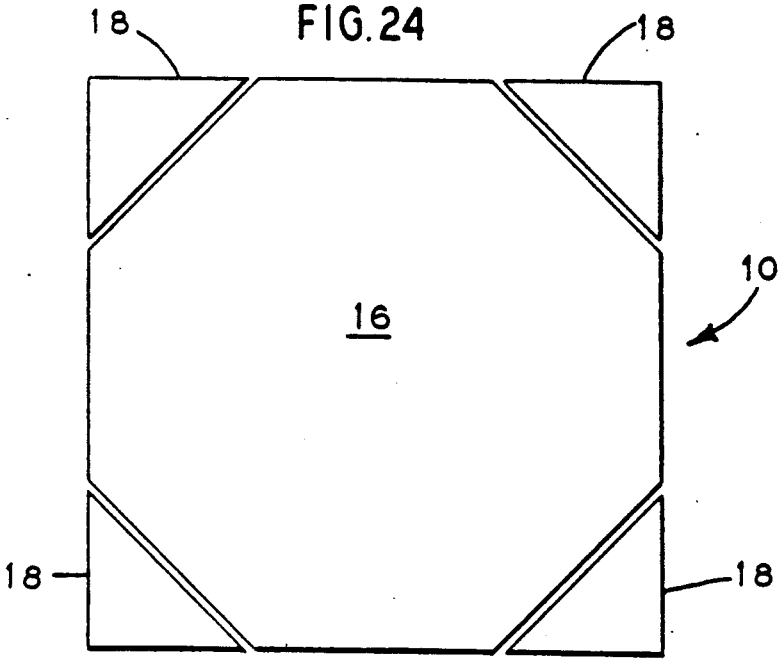
FIG. 24 discloses another alternate cross-section of a bundled substructure.

As stated earlier, the cross-section of central tower 16 need not be hexagonal as illustrated in the above embodiment. It can also be of a cruciform shape (FIG. 23) or it can be octagonal (FIG. 24) or it can be of some other shape. In any event, braces 18 are pivotally secured to central tower 16 so that upon launching, they can be unfolded and secured to the ocean bottom. Furthermore, by the configuration of folded substructure 10, transport barge 28 is provided with parallel launch ways 58 which makes loadout and launching considerably easier than would be possible if the structure had non-parallel legs 34.

In conclusion, then, one important feature of this invention is a central tower 16 having a cross-section that includes recesses into which braces 18 may be folded thereby forming a compact bundle for the fabrication and transportation operations. Furthermore, the bundle has no protrusions that will hamper fabrication and/or transportation.

What is claimed as invention is:

1. An offshore structure comprising:

a) an elongated central tower extending from the mudline to above the waterline, said tower configured to terminate slightly above said mudline, thereby forming a gap between said tower and said mudline, and comprising skirt piles to anchor said tower to said mudline across said gap;

b) a plurality of perimeter braces each pivotally connected to said tower, said braces extending to said mudline where they are anchored in place;

c) areas alongside said central tower configured to accept said braces therein, said tower and said recessed braces forming a unitary bundle of nearly uniform crosssection when thusly assembled; and, d) operating means for pivoting said braces from a bundled position generally parallel to said tower to an unbundled position at an angle to said tower.

2. The apparatus as set forth in claim 1 further comprising a strut pivotally connected between each said brace and said central tower.

3. The apparatus as set forth in claim 2 wherein said operating means comprise spaced slide rails secured along a portion of said tower for sliding each said strut from a folded position which is generally parallel to said tower to an unfolded position which is generally perpendicular to said tower.

4. The apparatus as set forth in claim 3 wherein said operating means further comprise a cable secured to said strut for moving said strut along said slide rails thereby pivoting said strut and hence its respective said brace outward.

5. The apparatus as set forth in claim 4 wherein each said strut, when in its unfolded position, effectively locks its respective said brace in its said unbundled position thereby preventing said brace from subsequently pivoting back towards said tower.

6. An offshore structure comprising:

a) an elongated tower rising above the waterline;

b) at least one brace pivotally secured at one end to an intermediate region of said tower, said brace being movable between a first position folded alongside said tower and a second position pivoted away from said tower and forming an angle with respect to said tower, said brace, when in its said second position, being configured to provide support to said tower thereby restraining said tower against the effects of external forces on said tower; and, c) operating means for pivoting each said brace outward thereby moving each said brace from its said first position to its said second position, said operating means comprising spaced slide rails secured along a portion of said tower and a strut secured between said slide rails and each said brace, said operating means moving said strut along said slide rails thereby pivoting its said respective brace outward, said operating means further comprising a cable secured to each said strut for moving said strut.

7. The apparatus as set forth in claim 6 wherein said strut effectively locks its respective said brace in its said second position.

8. An offshore structure to be transported on a barge comprising:

a) an elongated support column extending above the waterline and terminating slightly above the mudline thereby forming a gap between said column and said mudline, said support column being anchored to said mudline via skirt piles that extend across said gap;

b) perimeter braces pivotally secured to said support column, said braces being positioned adjacent and alongside said column while being transported to the installation site, said braces further being pivoted away from said column prior to installation upon the ocean bottom;

c) a strut securing a said brace to a slide assembly with said slide assembly being secured along a portion of said column; and, d) operating means for moving said slide assembly along said column thereby pivoting said braces between positions adjacent to and angled away from said column.

9. The apparatus as set forth in claim 8 wherein said operating means further comprise a cable secured to said slide assembly for moving and thereby pivoting said strut and its respective said brace outward.

10. The apparatus as set forth in claim 9 wherein said strut effectively locks its respective said brace in its said position angled away from said column.

11. A method of installing an offshore structure comprising the steps of:

a) fabricating, on land, a structure comprising a central tower and at least three perimeter braces that are pivotally secured to said tower and which extend beyond the end of said tower;

b) positioning, on land and prior to loading, said braces alongside said tower thereby forming a single bundled structure having a nearly uniform cross-section along its bundled length;

c) loading said bundled structure onto a launch barge and supporting said structure on said barge upon rows of launch ways positioned to support repetitive portions of said structure along its uniform cross-sectional length;

d) transporting said structure to the installation site;

e) removing said bundled structure from said barge by lifting or launching said structure from said rows of launch ways;

f) unbundling said structure and pivoting said braces outward away from said central tower; and, g) installing and securing said structure to the ocean floor.

12. The method as set forth in claim 11 wherein said tower and said braces are open trusses of fixed, predetermined length.

13. The method as set forth in claim 12 wherein said braces are configured to be secured to said mudline via skirt piles and wherein said end of said tower is configured to rest slightly above said mudline with skirt piles extending across this gap between said end and said mudline.

14. The method as set forth in claim 11 wherein said rows of launch ways are parallel.

15. The method as set forth in claim 14 further comprising the step of connecting a lower portion of said unfolded brace to said tower via a strut.

* * * * *